US010179951B2

(12) United States Patent
Nardi et al.

(10) Patent No.: US 10,179,951 B2
(45) Date of Patent: Jan. 15, 2019

(54) METHOD OF FORMING A MULTILAYERED COATING FOR IMPROVED EROSION RESISTANCE

(71) Applicant: Sikorsky Aircraft Corporation, Stratford, CT (US)

(72) Inventors: Aaron T. Nardi, East Granby, CT (US); Tahany Ibrahim El-Wardany, Bloomfield, CT (US); Jun Shi, Carmel, IN (US); Patrick Louis Clavette, Simsbury, CT (US); Xuemei Wang, South Windsor, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 207 days.

(21) Appl. No.: 15/000,845

(22) Filed: Jan. 19, 2016

(65) Prior Publication Data

US 2016/0130705 A1 May 12, 2016

Related U.S. Application Data

(62) Division of application No. 13/071,010, filed on Mar. 24, 2011, now Pat. No. 9,273,400.

(60) Provisional application No. 61/347,622, filed on May 24, 2010.

(51) Int. Cl.

| | |
|---|---|
| ***C23C 28/00*** | (2006.01) |
| ***C23C 4/02*** | (2006.01) |
| ***C23C 4/06*** | (2016.01) |
| ***C23C 4/10*** | (2016.01) |
| ***C23C 28/04*** | (2006.01) |
| ***C23C 24/04*** | (2006.01) |
| ***C23C 4/18*** | (2006.01) |

(52) U.S. Cl.

CPC ..... *C23C 28/36* (2013.01); *C23C 4/02* (2013.01); *C23C 4/06* (2013.01); *C23C 4/10* (2013.01); *C23C 4/18* (2013.01); *C23C 24/04* (2013.01); *C23C 28/044* (2013.01); *C23C 28/048* (2013.01); *C23C 28/44* (2013.01); *Y10T 428/2495* (2015.01); *Y10T 428/24983* (2015.01)

(58) Field of Classification Search

None

See application file for complete search history.

(56) References Cited

U.S. PATENT DOCUMENTS

| | | | | |
|---|---|---|---|---|
| 3,951,612 | A | 4/1976 | Gates et al. | |
| 4,503,130 | A * | 3/1985 | Bosshart | C23C 4/02 428/535 |
| 5,209,645 | A | 5/1993 | Kojima et al. | |
| 7,029,721 | B2 | 4/2006 | Hasz et al. | |
| 2005/0112411 | A1 | 5/2005 | Gray et al. | |

(Continued)

*Primary Examiner* — Michael P. Rodriguez

(74) *Attorney, Agent, or Firm* — Cantor Colburn LLP

(57) ABSTRACT

A method of applying a coating system to a substrate includes applying a first layer of a high hardness and high modulus of elasticity with an added metal to the substrate, applying a second layer of the high hardness and high modulus of elasticity in combination with the added metal to the first layer. A percent by volume of the added metal in the second layer is lower than the percent by volume of the added metal in the first layer. The method also includes applying two or more intermediate layers formed from an applied mixture of the high hardness, high modulus of elasticity material and a metal material between the first layer and the second layer.

8 Claims, 1 Drawing Sheet

(56) References Cited

U.S. PATENT DOCUMENTS

2007/0269676 A1* 11/2007 Singer ..... C23C 10/30
428/627
2009/0075057 A1* 3/2009 Kulkarni ..... C23C 4/02
428/323

* cited by examiner

METHOD OF FORMING A MULTILAYERED COATING FOR IMPROVED EROSION RESISTANCE

CROSS-REFERENCE TO RELATED APPLICATIONS

This nonprovisonal application claims priority to U.S. application Ser. No. 13/071,010, filed Mar. 24, 2011, now U.S. Pat. No. 9,273,400, issued Mar. 1, 2016, and U.S. Provisional Application No. 61/347,622, filed on May 24, 2010, the disclosures of which are incorporated herein by reference.

FEDERAL RESEARCH STATEMENT

This invention was made with Government support under Agreement No. W911W6-08-2-0006 for Rotor Durability Army Technology Objective (ATO). The Government has certain rights in the invention.

BACKGROUND OF THE INVENTION

The subject matter disclosed herein relates to erosion resistant coatings, particularly those utilized on helicopter rotor blades, propeller blades, fan blades, wind turbine blades, or any other part subjected to FOD (foreign object damage), particulate, and/or rain erosion damage.

When operating in a harsh environment, for example, a desert, blades of rotating components are subjected to severe erosion-inducing conditions. For example, sand, foreign objects or particulates impacting the leading edges of the blades can lead to excessive wear and cause the need to repair and/or replace blades at a high rate resulting in a high logistics and maintenance impact for the user. In some environments, rain can also be a significant erosion concern resulting in significant material loss due to repeated impact stressing.

The art would well-receive an improved erosion resistance coating to reduce wear on components thereby reducing logistics and maintenance costs for the user.

BRIEF DESCRIPTION OF THE INVENTION

According to one aspect of the invention, a method of applying a coating system to a substrate includes applying a first layer of a high hardness and high modulus of elasticity with an added metal to the substrate, applying a second layer of the high hardness and high modulus of elasticity in combination with the added metal to the first layer. A percent by volume of the added metal in the second layer is lower than the percent by volume of the added metal in the first layer. The method also includes applying two or more intermediate layers formed from an applied mixture of the high hardness, high modulus of elasticity material and a metal material between the first layer and the second layer. A percent by volume of the metal material in one of the two or more coating layers closest to the substrate is greater than a percent by volume of the metal material in another of the two or more coating layers farther from the substrate. The coating system has a modulus of elasticity and hardness which increases from the first layer to the second layer.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
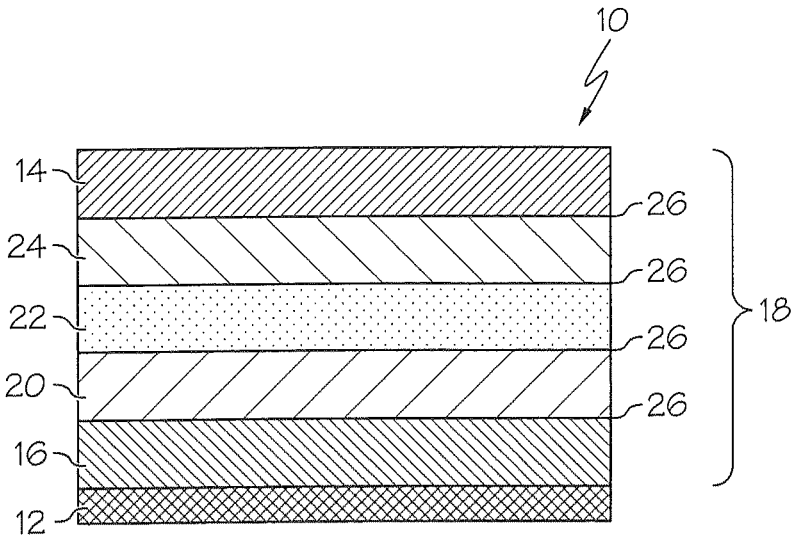
FIG. 1 is a schematic view of an embodiment of a multilayer coating as applied to a substrate.

Shown in FIG. 1 is a schematic representation of an embodiment of a multilayer coating 10 as applied to a substrate 12, for example a blade of a rotating wing aircraft. In some embodiments, the substrate 12 is formed of a nickel or titanium alloy. The multilayer coating 10 is configured for improved FOD, or large particle damage, resistance and particle erosion, or small particle damage, resistance. The finished coating 10 has a gradually decreasing modulus of elasticity and hardness through its thickness 18 from an outer layer 14 to an innermost layer 16 located at the substrate. This results in an outer layer 14 which has high erosion resistance, while the gradual decrease to a lower modulus of elasticity to the innermost layer 16 reduces stress induced by impact which increases FOD resistance of the coating 10.

Materials utilized in embodiments of coatings 10 include coating materials that are applied using high-velocity oxy-fuel (HVOF), plasma spray, or cold spray coating processes. Examples of coating materials are combinations of a hard and stiff ceramic phase, such as tungsten carbide (WC), chromium carbide ($Cr_3C_2$), silicon carbide, or silicon nitride, and a softer, lower stiffness phase such as cobalt, nickel, chromium, aluminum, iron and/or copper alloys, with specific compositions of the layers of coating 10 varied to produce a coating 10 as described above having a gradual reduction in modulus of elasticity and hardness throughout the thickness 18. Each layer is a combination of coating material and metal that is metallurgically compatible with the previous layer. The coating material is blended with varying amounts of an added metal to vary the modulus of elasticity of the coating 10 as desired. In one exemplary embodiment, the coating 10 comprises layers of differing blends by volume of coating WC-12% Co and the added metal, nickel. In some embodiments, the nickel is present in the form of a nickel braze alloy. The nickel braze alloy is utilized to modify the modulus of elasticity, hardness and ductility of the coating 10 while improving cohesive bonding within the coating 10 and adhesive bonding to the substrate 12.

The innermost layer 16 of the coating 10 is a metal or high metal content material, for example, a layer of nickel braze alloy. The innermost layer 16 is metallurgically compatible with the substrate 12 material. This layer has the lowest modulus of elasticity of the layers of the coating 10. A second layer 20 is applied to the innermost layer 16 and includes a combination of hard and stiff coating material with added metal which is metallurgically compatible with the innermost layer 16. For example, in some embodiments, the second layer 20 includes 50% by volume of WC-12% Co powder blended with 50% by volume of nickel braze alloy. Subsequent layers are applied, each with decreasing added metal content, which will increase the modulus of elasticity and hardness of the layer. Further, each subsequent layer is metallurgically compatible with the previous layer to which it is applied. For example, a third layer 22, applied to the second layer 20, includes 70% by volume of WC-12% Co powder blended with 30% by volume of nickel braze alloy. A fourth layer 24, applied to the third layer 22, includes 90% by volume of WC-12% Co powder blended with 10% by volume of nickel braze alloy.

Finally, the outermost layer 14, applied to the fourth layer 24, comprises WC-12% Co fine grit size coating material and has the highest modulus of elasticity of the layers 16, 20, 22, 24 and 14 with each layer having an increased modulus of elasticity over preceding ones. It is to be appreciated that the materials and ratios utilized in the coating 10 of this embodiment are merely exemplary and uses of other materials and volumetric ratios are contemplated within the scope of the present disclosure. In other embodiments, the number of layers could be increased to, for example, 7 or 8 layers, or the number of layers could be decreased to, for example 3 or 4, as long as the gradual reduction in elastic modulus from outermost layer 14 to innermost layer 16 is maintained.

In the embodiment of FIG. 1, the layers 16, 20, 22, 24 and 14 are of equal thickness, and in some embodiments the thickness of each layer is about sixty-three microns. It is to be appreciated that other embodiments may include layers of unequal thicknesses and/or layers of equal thicknesses other than sixty-three microns in order to produce a coating 10 having desired impact and erosion resistant properties.

Figure 2:
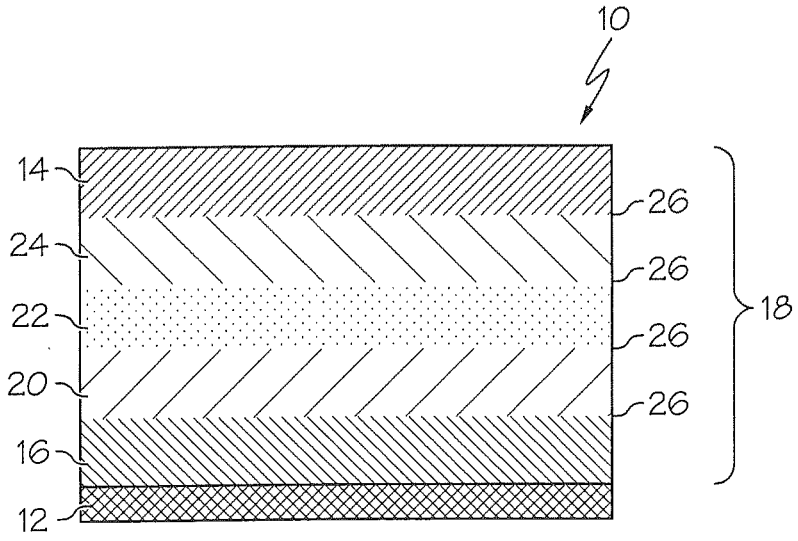
FIG. 2 is a schematic view of an embodiment of a heat treated multilayer coating of a substrate.

The coating 10 is applied by any suitable process, for example, thermal spray, plasma spray or cold spray process with layers applied beginning with application of innermost layer 16 to the substrate 12. After all layers are applied, the substrate 12 and coating 10 are subjected to a heat treatment process. The heat treatment process raises the temperature of the coating to near the solidus of the nickel braze alloy, or the temperature at which the nickel braze alloy begins to melt. Such a heating minimizes the flow of the nickel braze alloy while still promoting diffusion bonding through a mixing of the braze alloy material with the high hardness and high modulus of elasticity coating material throughout the coating 10. A schematic of the coating 10 after heat treatment is shown in FIG. 2. After heat treatment, transitions 26 (in FIG. 1) between the layers are diffused, resulting in a smoother gradient of modulus of elasticity and hardness through the thickness 18 of the coating 10. The diffusion of the transitions 26 further decreases the stress induced by impact of the coating 10, thereby increasing FOD tolerance of the coating 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of applying a coating system to a substrate comprising:

applying a first layer of a high hardness and high modulus of elasticity with an added metal directly to the substrate;

applying a second layer of the high hardness and high modulus of elasticity in combination with the added metal to the first layer, wherein a percent by volume of the added metal in the second layer is higher than the percent by volume of the added metal in the first layer;

applying two or more intermediate layers formed from an applied mixture of the high hardness, high modulus of elasticity material and a metal material between the first layer and the second layer, wherein a percent by volume of the metal material in one of the two or more intermediate coating layers closest to the substrate is greater than a percent by volume of the added metal in the first layer and less than a percent by volume of the metal material in another of the two or more coating layers farther from the substrate, the coating system having a modulus of elasticity and hardness which increases from the first layer to the second layer.

2. The method of claim 1, further comprising diffusing a transition between adjacent layers of the coating system thus resulting in a gradual transition of elastic modulus and hardness through a thickness of the coating.

3. The method of claim 2, wherein the diffusion is accomplished via heat treatment process that promotes mixing of portions of the added metal with the high hardness and high modulus of elasticity material.

4. The method of claim 3, wherein the heat treatment raises the temperature of the added metal to near the solidus of the added metal thus minimizing flow of the added metal while promoting diffusion bonding throughout the coating system.

5. The method of claim 1, wherein each layer of the coating system is applied via a high-velocity oxy-fuel (HVOF), plasma spray, or cold spray coating process.

6. The method of claim 1, further comprising applying a layer of substantially entirely added metal to the substrate prior to applying the first layer.

7. The method of claim 1, wherein applying the two or more intermediate layers formed from an applied mixture of the high hardness, high modulus of elasticity material and the metal material includes applying two or more intermediate layers formed from an applied mixture of the high hardness, high modulus of elasticity material and at least one of cobalt, nickel, chromium, aluminum, iron, a copper alloy and a nickel braze alloy.

8. The method of claim 1, wherein applying the first layer includes applying a layer of material including at least one of tungsten carbide (WC) and cobalt (Co).

* * * * *